US005589010A

United States Patent [19]

Gay

[11] Patent Number: 5,589,010

[45] Date of Patent: Dec. 31, 1996

[54] ANNEALED POLYMER-BONDED SOFT MAGNETIC BODY

[75] Inventor: David E. Gay, Noblesville, Ind.

[73] Assignee: General Motors Corporation, Detroit, Mich.

[21] Appl. No.: 563,436

[22] Filed: Nov. 24, 1995

Related U.S. Application Data

[60] Continuation-in-part of Ser. No. 241,069, May 11, 1994, abandoned, which is a division of Ser. No. 44,421, Apr. 9, 1993, abandoned.

[51] Int. Cl.[6] ..... H01F 1/22

[52] U.S. Cl. ..... 148/306; 252/62.54

[58] Field of Search ..... 148/104, 105, 148/306; 252/62.54, 62.55

[56] References Cited

U.S. PATENT DOCUMENTS

| | | | |
|---|---|---|---|
| 4,358,419 | 11/1982 | Byrne et al. | 419/10 |
| 4,543,208 | 9/1985 | Horie et al. | 252/62.54 |
| 4,601,765 | 7/1986 | Soileau et al. | 148/104 |
| 4,713,288 | 12/1987 | Kokaku et al. | 428/336 |
| 4,725,490 | 2/1988 | Goldberg | 428/292 |
| 4,957,668 | 9/1990 | Plackard et al. | 148/105 |
| 5,028,497 | 7/1991 | Somezawa et al. | 252/62.54 |
| 5,096,509 | 3/1992 | Endoh et al. | 148/104 |
| 5,098,940 | 3/1992 | Brooks | 524/227 |
| 5,211,896 | 5/1993 | Ward et al. | 264/126 |
| 5,268,140 | 12/1993 | Rutz et al. | 419/54 |
| 5,271,891 | 12/1993 | Gay | 419/36 |

FOREIGN PATENT DOCUMENTS 0112577 4/1984 European Pat. Off. .

OTHER PUBLICATIONS

E. J. Powers et al, History and Development of Polybenzimidazole, Hoechst Celanese, American Chemical Society, New York, Apr. 15–18, 1986.

"Technical Data Sheet I–201A Cable Coating", IMITEC Inc., P.O. Box 1412, 1990 Maxon Road, Schanectady, New York 12301, Mar. 1991.

Hawley's Condensed Chemical Dictionary, Eleventh Edition 1987, Anode Process, p. 83.

S. Minakawa et al, "Warm Consolidation of Amorphous Metallic Powder Composites for AC Applications", IEEE Transactions on Magnetics, vol. 23, No. 5, Sep. 1987, pp. 3245–3247.

Encyclopedia of Polymer Science and Engineering, vol. 2–A Wiley–Interscience Publication, John Wiley & Sons, pp. 43–53, 1985.

*Primary Examiner*—George Wyszomierski

*Attorney, Agent, or Firm*—Lawrence B. Plant

[57] ABSTRACT

A compression molded soft magnetic core comprising annealed soft ferromagnetic metal particles bonded together in a thermoplastic polymer matrix having a heat deflection temperature greater than about 400° C. and selected from the group consisting of polybenzimidazole and polyimides.

3 Claims, 4 Drawing Sheets

ANNEALED POLYMER-BONDED SOFT MAGNETIC BODY

This patent application is related to co-pending U.S. patent application Ser. No. 07/976,859 filed Nov. 16, 1992, and is a Continuation-in-Part of U.S. patent application Ser. No. 08/241,069 filed May 11, 1994, now abandoned which is a divisional application of U.S. patent application 08/044,421 filed Apr. 9, 1993 now abandoned.

This invention relates to a soft magnetic core made by a method in which a compression molded magnetic article is formed from soft ferromagnetic metal particles which are coated with a polymeric material, and then annealed so as to substantially relieve the stresses induced in the particles during the compression molding process without significantly deteriorating the polymeric coating material. The resulting magnetic article exhibits enhanced magnetic permeability and reduced coercivity without a significant loss in mechanical properties.

BACKGROUND OF THE INVENTION

The use of powdered metals, and particularly iron and its alloys, is known for forming magnets, such as soft magnetic AC cores for transformers, inductors, motors, generators, and relays. An advantage to using powdered metals is that forming operations, such as compression, injection molding, or isostatic pressing techniques, can be used to form intricate molded part configurations, such as magnetic cores, without the requirement for additional machining and/or piercing operations. As a result, the formed part is often substantially ready for use within its working environment as formed by the molding process.

Molded soft magnetic cores for AC applications generally should have low magnetic core losses. To provide low core losses, the individual metal particles within the magnetic core must be electrically insulated from each other. Numerous types of insulating materials, which also act as the binder required for molding, have been suggested by the prior art, including inorganic materials such as iron phosphate and alkali metal silicate, as well as an extensive variety of organic polymeric materials. It is also known to coat a powdered metal with an inorganic undercoating and then provide an organic topcoat. In addition to providing adequate insulation and adhesion between the metal particles upon molding, the coating material should also have the ability to provide sufficient lubrication during the molding operation so as to enhance the flowability and compressibility of the particles, therefore enabling the particles to attain maximum density and strength.

A shortcoming of the prior art arises in that a magnetic core's maximum operating temperature will often be determined by the heat resistant properties of the insulating material used to adhere the metal particles together. It is essential that the integrity of the insulating material be maintained so as to insulate the individual metal particles and thereby provide low core losses for AC applications. If the magnetic core is exposed to a temperature which exceeds the degradation temperature of the coating material, the ability of the coating material to encapsulate and adhere the particles will likely be degraded, which could ultimately destroy the magnetic core. Even where physical destruction of the magnetic core does not occur, the magnetic field characteristics of the magnetic core will likely be severely impaired because of the degradation of the insulating capability of the coating material due to the elevated temperatures.

As disclosed in copending U.S. patent application Ser. No. 07/976,859, filed Nov. 16, 1992, which is assigned to the assignee of the present invention, polybenzimidazole (PBI), aromatic polyamides such as polyphthalamide (PPA), and certain polyimides have been found to perform well as the coating material for powdered iron and/or powdered iron alloys. Each of these preferred thermoplastic polymers have operating temperatures, as defined by their heat deflection temperatures, which permit their use in high temperature applications of greater than about 270° C. As a result, these preferred polymers perform well, particularly with respect to their ability to withstand relatively high operating temperatures such that the mechanical properties and desired magnetic characteristics of the molded magnetic core do not deteriorate at high temperatures.

Polybenzimidazole, an aromatic polyamide such as polyphthalamide, and the preferred polyimides also have the ability to adhere well to the underlying iron particle, bind the iron particles together, and resist thermal and chemical attack, while also serving as a lubricant during the compression molding process so as to promote high density and strength of the magnetic core. The ability of an encapsulating material to serve as a lubricant during the molding process is also important in that unsuitably low densities correspond to a lower magnetic permeability of the magnetic core.

However, a shortcoming associated with compression molded magnetic cores is that work hardening of the metal particles occurs during the compression molding process, inducing stresses within the magnetic cores that result in reduced magnetic permeability, increased coercivity and possibly higher core losses. As an example, the magnetic permeability of magnetic cores formed by conventional compression molding techniques typically does not exceed about 125 Gauss/Oersteds (G/Oe) at about 50 oersteds field intensity and about 100 to about 400 Hz. As a result, magnetic cores which are compression molded from encapsulated iron particles generally do not exhibit sufficiently high magnetic permeability to be useful in AC applications such as generators, stator cores, transformers and the like, which require magnetic permeability in excess of about 175 G/Oe as measured at about 50 oersteds field intensity and about 100 to about 400 Hz. Moreover, work hardening of the metal also increases the coercivity of soft magnetic cores. Coercivity is that property of the metal that is measured by the maximum value of coercive force ($H_c$) which is the magnetizing force required to bring the induced magnetism to zero in a magnetic material which is in a symmetrically cyclically magnetized condition. High coercivity is undesirable in soft magnets because energy is wasted bringing the induced magnetism back to zero. Moreover, in low frequency (i.e., less than about 200 Hz) applications most of the core losses are attributable to hystersis losses which are controlled by the metal component of the core and can only be reduced by attention to the metal component. Stress relieving the metal component is one way to reduce its coercivity.

To relieve the undesirable stresses induced into the metal particles during compression molding, it would be necessary to anneal a magnetic core at a temperature of at least about 450° C., and then cool the magnetic core without quenching. However, polymer coatings generally cannot withstand such temperatures, and tend to degrade and pyrolyze, causing a significant loss of strength and magnetic properties in the magnetic core.

Thus, it would be desirable to provide a method for enhancing the magnetic permeability of compression molded magnetic cores which are formed from encapsulated powdered metals, wherein the coating material has the ability to withstand processing temperatures which are sufficient to anneal the magnetic core so as to relieve the stresses induced by the compression molding process. Furthermore, it would be desirable that such a method not cause a corresponding loss in the mechanical properties and magnetic characteristics of the molded magnetic core as a result of the degradation and/or pyrolyzation of the coating material during annealing. In addition, such a coating material should be soluble in a suitable solvent, and capable of improving lubrication during the molding process and providing adhesion between the metal particles after molding, so as to attain maximum density and strength of the as-molded article.

SUMMARY OF THE INVENTION

According to the present invention, there is provided a method for enhancing the magnetic permeability and reducing the coercivity of compression molded soft magnetic cores which are formed from encapsulated powdered metals, wherein the method entails the use of thermoplastic coating materials for encapsulating or coating the powdered metals, such as iron and iron alloys, which are capable of withstanding temperatures that are sufficient to anneal the metal. As a result, the stresses induced in the metal by the compression molding process can be relieved without a substantial loss in the mechanical properties and magnetic characteristics of the magnetic core as a consequence of the degradation of the coating material during annealing.

Thermoplastic coating materials which have been determined to be most capable of withstanding the necessary annealing temperatures are polybenzimidazole (PBI) and specific polyimides (PI) having a heat deflection temperature of at least about 400° C.

It has been determined that soft magnetic articles compression molded from metal particles encapsulated with these preferred coating materials can sustain temperatures, generally in excess of about 450° C., for a duration which is sufficient to relieve the work hardening stresses that are induced into the metal particles by the compaction process. The elimination of these stresses is believed to enhance the magnetic permeability and reduce the magnetic coercivity of the magnetic article. According to this invention, the preferred coating materials do not significantly degrade or pyrolyze at these annealing temperatures, thus alleviating any loss in mechanical properties such as strength, and/or magnetic properties such as permeability, of the magnetic core.

Each of the preferred coating materials has a heat deflection temperature in excess of about 400° C., such that soft magnetic articles molded from metal particles coated with any of the preferred coating materials are particularly suitable for use at relatively high operating temperatures. Specifically, these coating materials enable the magnetic core to substantially retain its mechanical and magnetic properties at operating temperatures up to at least the corresponding heat deflection temperature of the particular coating material used.

The preferred thermoplastic coating materials are also sufficiently soluble, highly resistant to chemical attack, and exhibit relatively high strength and good dielectric properties. As a result, the coating materials can be applied by fluidized bed processes, and are suitable for use in applications which require high strength and insulating properties within a relatively high temperature environment. The coating materials are capable of adhering the metal particles together strongly so as to form a molded article using a compression molding process. Furthermore, core losses produced by the insulating effect of the coating materials are suitably low to ensure the desired magnetic characteristics of the magnetic core. Finally, the coating materials are sufficiently lubricous to promote compaction and densification during the compression molding process. The above capabilities are particularly advantageous for the manufacture of magnetic cores which are compression molded from the coated metal particles.

The preferred coating materials can achieve the above advantages while being present in relatively low quantities, i.e., less than about one weight percent as compared to the mass of the encapsulated metal particles. The coated metal particles are introduced into a suitable molding apparatus, such as a compression or injection molding machine or isostatic press, where the coated metal particles are compressed within a heated mold cavity under a suitably high pressure to compact the coated metal particles to produce a dense, strong and solid magnetic article.

The soft magnetic article is annealed at a temperature and for a duration which are sufficient to relieve the work hardening induced into the metal particles by the molding process, so as to enhance the magnetic permeability and reduce the magnetic coercivity of the magnetic article, and is then allowed to cool, preferably at a rate slow enough to avoid the formation of thermally-induced stresses. The preferred thermoplastic coating materials are capable of withstanding the annealing process, such that there is no significant degradation or pyrolyzation of the coating material. Consequently, no significant loss in the strength or the AC magnetic properties of the magnetic article occurs as a result of a detrimental change in the preferred coating materials. Thus, soft magnetic cores which are compression molded from metal particles encapsulated with the preferred coating materials of this invention exhibit sufficiently high magnetic permeability to be useful in AC applications such as generators, stator cores, transformers and the like, which require magnetic permeability such as in excess of about 175 G/Oe as measured at about 50 oersteds field intensity and about 100 to about 400 Hz. Moreover, such cores are useful in low frequency (i.e., <200 Hz) applications owing to their reduced coercivity.

Other objects and advantages of this invention will be better appreciated from the following detailed description.

BRIEF DESCRIPTION OF THE DRAWINGS

The above and other advantages of this invention will become more apparent from the following description taken in conjunction with the accompanying drawing wherein.

DETAILED DESCRIPTION OF THE INVENTION

Figure 1:
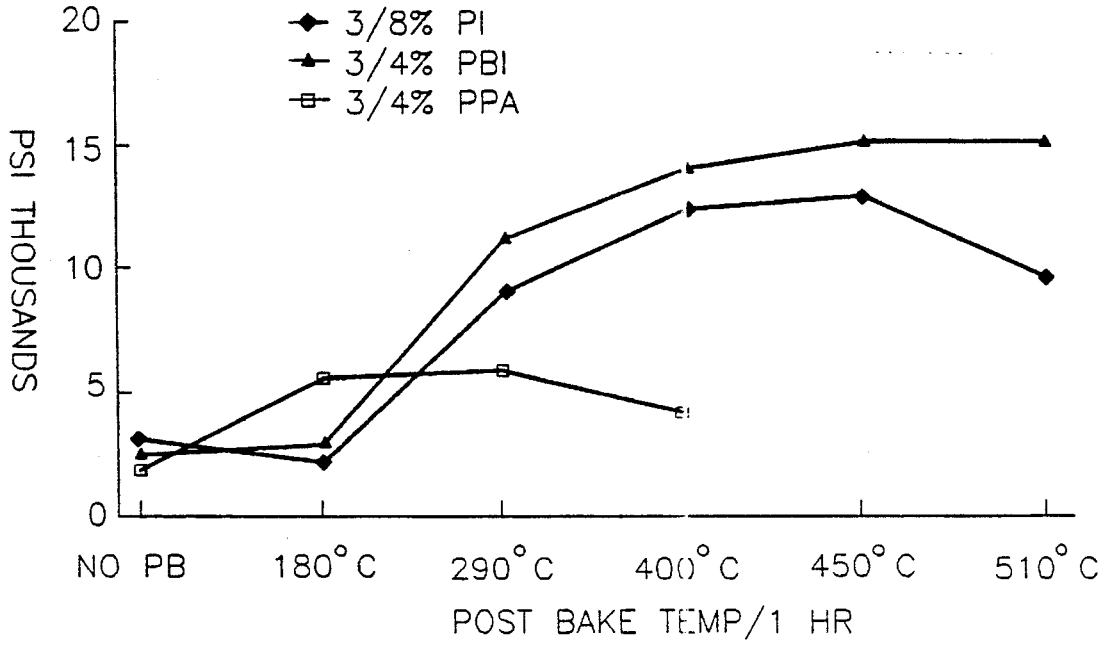
FIGS. 1 and 2 are graphs which illustrate the effect that various annealing temperatures have on the mechanical properties of magnetic articles formed in accordance with this invention.

The method of this invention involves the use of a group of thermoplastic polymeric coating materials for coating powdered materials, and more particularly, for encapsulating powdered iron and ferromagnetic iron alloys which are molded under pressure so as to form, for example, soft magnets that are particularly suitable for use as AC magnetic cores used in the automotive industry. The preferred polymeric coating materials are capable of withstanding elevated temperatures which are sufficient to anneal the magnetic cores for the purpose of relieving stresses induced into the metal during the molding process, so as to result in the enhancement of the magnetic permeability and reduction of the coercivity of the magnetic cores. It is to be noted that the molding of other types of articles is also within the scope of the teachings of this invention.

According to the present invention, the preferred thermoplastic polymeric materials are polybenzimidazole (PBI) and polyimides (PI) having heat deflection temperatures of at least about 400° C. Such polyimides include those derived from 3-4'oxydianiline and polymethylene dianiline. Polybenzimidazole is available under the tradename Celazole U-60 from the Hoechst Celanese Corporation. A preferred polyimide that is derived from 3-4'oxydianiline and polymethylene dianiline is available under the tradename Imitech 201A from Imitech. It is to be noted that although these are the preferred polymeric coatings of this invention, it is foreseeable that other thermoplastic polyimides and polybenzimidazoles having a suitably high heat deflection temperature could also be foreseeably used.

Each of the preferred thermoplastic coating materials is characterized by excellent mechanical properties and dielectric characteristics over a temperature range which exceeds at least about 400° C., as generally determined by a standardized heat deflection temperature per ASTM test D-648 entitled "Deflection Temperature of Plastics Under Flexural Load", wherein a sheet of the polymeric material is supported at three points and deflection is measured as a function of increasing temperature.

Thermoplastic polybenzimidazole has a heat deflection temperature of about 435° C., while the preferred thermoplastic polyimides, which are derived from 3-4'oxydianiline and polymethylene dianiline, have a heat deflection temperature of at least about 400° C. It was first thought that these materials would not retain their integrity at higher annealing temperatures, thus causing a degradation in the integrity of the molded article formed from the mass of encapsulated particles. Yet, it was determined that molded articles formed from ferromagnetic metal particles coated with the preferred polybenzimidazole are able to withstand annealing temperatures of at least about 500° C. for an hour, allowing such magnetic cores to be annealed to relieve the stresses induced into the metal particles during the molding process. In addition, molded articles formed from ferromagnetic particles coated with the preferred polyimide, such as those derived from 3-4'oxydianiline and polymethylene dianiline, are also able to withstand annealing temperatures of at least about 450° C. for an hour. Even at these relatively high temperatures, the integrity of the physical and dielectric properties of the magnetic core are retained, resulting in little, if any, degradation in the magnetic characteristics of the molded article, such as measured by magnetic core loss.

In addition, the preferred coating materials are each soluble in a suitable solvent, thereby permitting their use in the preferred Wurster-type fluidized coating process described above and known in the art. Specifically, polybenzimidazole is soluble in 1-methyl-2-pyrrolidone with lithium chloride, and the preferred polyimides are generally soluble in N-methyl-2-pyrrolidone, though it is foreseeable that other suitable solvents exist and could be used. However, the preferred coating materials of this invention tend to be insoluble in solutions other than their named solvents, thereby making them substantially impervious to chemical attack within most environments, such as that for an engine component of an automobile.

The solubility of both polybenzimidazole and the preferred polyimide in at least one solvent is advantageous in view of the preferred coating and molding processes utilized by the present invention. Though it is foreseeable that the preferred coating materials, and particularly polybenzimidazole, could be used in a slurry coating process which does not require that the coating material be first dissolved in a solvent. However, it is generally preferable to use a fluidized coating process, wherein the preferred polymer is in solution so as to achieve a more uniform coating on the powdered materials, thereby promoting low core losses.

According to the present invention, magnetic articles which are molded from ferromagnetic particles encapsulated with the preferred coating materials are capable of withstanding annealing temperatures of at least 450° C. for a duration sufficient to relieve the stresses induced into the metal by the molding process, so as to enhance the magnetic article's permeability. After annealing, the mechanical and physical properties of the preferred coating materials are retained to provide sufficient adhesion between adjacent metal particles, so as to sustain the desired strength and shape of the magnetic core after molding. Furthermore, the insulating capability of the preferred coating materials is sufficiently retained to minimize magnetic core losses in the molded article.

The usable temperature for ferromagnetic metal particles coated with any of the preferred coating materials is in excess of about 375° C., thus permitting their extended use in high temperature applications. Correspondingly, the magnetic core loss properties of the molded article are also retained at these elevated temperatures.

The preferred coating materials also have desirable flow and feed properties, and are compressible and dense, making them highly suitable for use in compression molding processes. As a result, the preferred coating materials can be readily handled with conventional delivery equipment. Furthermore, maximum metal particle density can be achieved with a compression molding process.

Each of the preferred coating materials is able to achieve the above advantages while being present in quantities lower than about one weight percent, as compared to the total weight of the encapsulated metal particles. Most preferably, polybenzimidazole is present in the range of about 0.5 to about one weight percent, and the preferred polyimide is present in the range of about 0.25 to about 0.75 weight percent. It is foreseeable that greater quantities of the preferred coating materials could be used, though a corresponding change in physical properties and/or a reduction in magnetic permeability of the molded article may result.

The balance of the molded article, about 99 weight percent, consists of ferromagnetic metal particles sized preferably in the range of about 5 to about 400 microns, and more preferably in the range of about 25 to about 350 microns, so as to attain magnetic cores of high permeability, as is discussed more fully later.

The preferred method for coating the ferromagnetic metal particles utilizes a Wurster-type spray-coating fluidized bed of the type known to those skilled in the art, although other methods which produce a uniform coating on the particles could also be used. The fluidized bed essentially includes a concentric pair of upright cylindrical vessels, one within the other. The outer vessel has its lower axial end closed to form a floor for the outer vessel only, with the inner vessel being suspended above this floor. The floor has perforations of various sizes through which heated air is drawn through both vessels. The perforations are sized and located such that the majority of the air flow will occur up through the inner vessel, and then down between the inner vessel and the outer vessel. Prior to introduction into the fluidized bed, it may be preferred, although not necessary, that the metal particles be presorted according to size, so as to promote substantially uniform coating thicknesses on the metal particles during the coating process.

At start-up, a batch of the powdered metal is deposited onto the floor of the vessel, and then circulated with heated air at a rate sufficient to fluidize the particles. According to the batch size and particle sizes, the flow rate of the air will generally be in the range of about 100 to about 200 cubic meters per hour. Also, the air temperature will generally range between about 55° C. and 80° C. when the coating process begins, but will vary during the coating process with the introduction and evaporation of the solvent. If the air temperature is too low, the solvent will not evaporate upon contact with the metal particle thereby resulting in a poorly coated particle, while if the air temperature is too high, the solvent evaporates too quickly thereby also preventing the formation of a uniformly thick coating on the particles. As the coating process progresses, each of the particles are randomly coated an extraordinarily large number of times, so as to ensure a uniformly thick coating on the particle.

A spray nozzle located on the floor under the inner chamber serves to introduce one of the preferred coating materials, which is dissolved in an appropriate solvent, into the chamber. The solution is preferably about 5 to about 15 weight percent coating material, and more preferably about 10 weight percent coating material, so as to maximize the efficiency of the coating procedure, though suitable coating results can be obtained with an extremely large range of solutions.

The solution is then sprayed into the fluidized bed. Within the fluidized bed, the solvent is evaporated, leaving the coating material encapsulated onto the particles. Once coated, the encapsulated metal particles are recirculated by the action of the heated air between the confined volumes defined by the inner and outer vessels. Circulation is continued until each metal particle has acquired a uniform and sufficiently thick coating of the particular coating material used, preferably in accordance with the respective weight percentages indicated above for each of the coating materials of this invention. Typically, the coating thickness will be in the range of about 0.3 to about 4.5 microns for metal particles in the preferred range of about 5 to about 400 microns.

As stated previously, other deposition methods may also be employed so long as a substantially uniform coating on each particle is obtained.

Thereafter, the coated metal particles may be introduced into a suitable molding apparatus. Typical molding processes used to form, for example, magnetic cores, include compression and injection molding and isostatic pressing, and are generally performed at mold temperatures ranging from about room temperature to about 370° C., and more preferably from about 260° C. to about 370° C., with the particles being pre-heated to about 150° C. to about 175° C. At these temperatures, the preferred coating materials are sufficiently fluid to flow under pressure during the molding operation, while also being sufficiently viscous to adhere to the metal particles and provide a lubricating action between adjacent metal particles. As a result, automated handling equipment can be used to process and feed the coated metal particles throughout the coating and molding processes, resulting in shorter cycle times. Yet the compaction molded articles, such as soft magnetic cores, formed by these processes are characterized by being physically strong and dense, so as to generally enable immediate handling and use of the as-formed molded articles, as well as permit machining of the molded articles if necessary.

In that the coated metal particles and the mold cavity are preheated, the coated metal particles will readily flow into the mold cavity and, when subjected to typical molding pressures of about 20 to about 50 tons per square inch (tsi), will flow sufficiently to become compacted and form a molded article, such as a ferromagnetic core whose density is preferably greater than about 7.0 grams per cubic centimeter. The coating and molding processes described above can be widely varied to alter the physical and magnetic properties of the molded article, as is known in the art.

The molded article is then annealed at an appropriate temperature so as to relieve the work hardening stresses induced into the metal during the molding process. The preferred temperature range for the annealing process of this invention depends in part on the particular coating material chosen. Generally, an annealing temperature of between about 425° C. and about 550° C. is preferred for the coating materials of this invention, with a more preferred range of about 475° C. to about 550° C. for molded articles formed with polybenzimidazole, and a more preferred range of about 425° C. to about 500° C. for molded articles formed with the preferred polyimide. The duration of the annealing process is preferably about 0.5 to about 2 hours for typical AC applications. While a duration of about 1 hour appears to be sufficient for most applications, the optimal duration for any given molded article will be extremely dependent on the mass and geometry of the molded article. Accordingly, it is foreseeable that annealing durations of less than 0.5 hours or in excess of 2 hours may be preferable under some circumstances.

After annealing, the molded article is allowed to cool without quenching, preferably at a rate slow enough to avoid the formation of thermally-induced stresses within the molded article. A suitable method is to allow the molded article to cool by natural convection within the annealing oven as the oven cools from its heating cycle.

To determine the preferred annealing temperature for magnetic bodies formed from ferromagnetic particles coated in accordance with this invention, individual quantities of ferromagnetic particles (i.e., Hoeganaes 1000C iron powder) were selectively coated with one of the preferred coating materials in accordance with the fluidized bed process described above. The ferromagnetic particles generally had a particle size of about 5 to about 300 microns, and were coated with either polybenzimidazole (Celazole U-60 from the Hoechst Celanese Corporation), or the preferred polyimide (Imitech 201A from Imitech). For the particles encapsulated with polybenzimidazole, the coating material was deposited to a thickness sufficient to result in it being about 0.75 weight percent of the mass of the coated ferromagnetic particles, while particles encapsulated with the polyimide were coated to a thickness sufficient to result in the polyimide being about 0.375 weight percent of the mass of the coated particles. These particular weight percents were determined to be the optimal amount for each of the polymeric coatings.

For comparison, ferromagnetic particles were also coated with a polyphthalamide obtained from Amoco Performance Products, Inc., under the tradename Amodel AD-1000. Polyphthalamide is disclosed as a preferred coating for forming molded magnetic articles suitable for high temperature use in copending U.S. patent application Ser. No. 07/976,859. The polyphthalamide was deposited in accordance with the teachings of Ser. No. 07/976,859, so as to compose about 0.75 weight percent of the coated ferromagnetic particles.

A transverse rupture bar of each of the selected coating materials was then formed by room temperature compression molding at a molding pressure of about 50 tsi. The transverse rupture bar samples were approximately 1.25 inches long, 0.5 inch wide, and 0.375 inch thick. The polyimide-coated transverse rupture bars had densities of about 7.4 g/cm$^3$, while the polybenzimidazole-coated transverse rupture bars had densities of about 7.5 g/cm$^3$.

After forming, test bars for each of the coating materials were selectively annealed at temperatures of about 180° C., 290° C., 400° C., 450° C. and 510° C., with one sample of each being left unannealed for comparison. The annealing time for the samples was about one hour. Strength tests were then conducted to determine the test bars' loads at 0.2% offset and loads at failure, in accordance with ASTM test B528-83A, entitled "Transverse Rupture Strength of Sintered Metal Powder Specimens."

Figure 2:
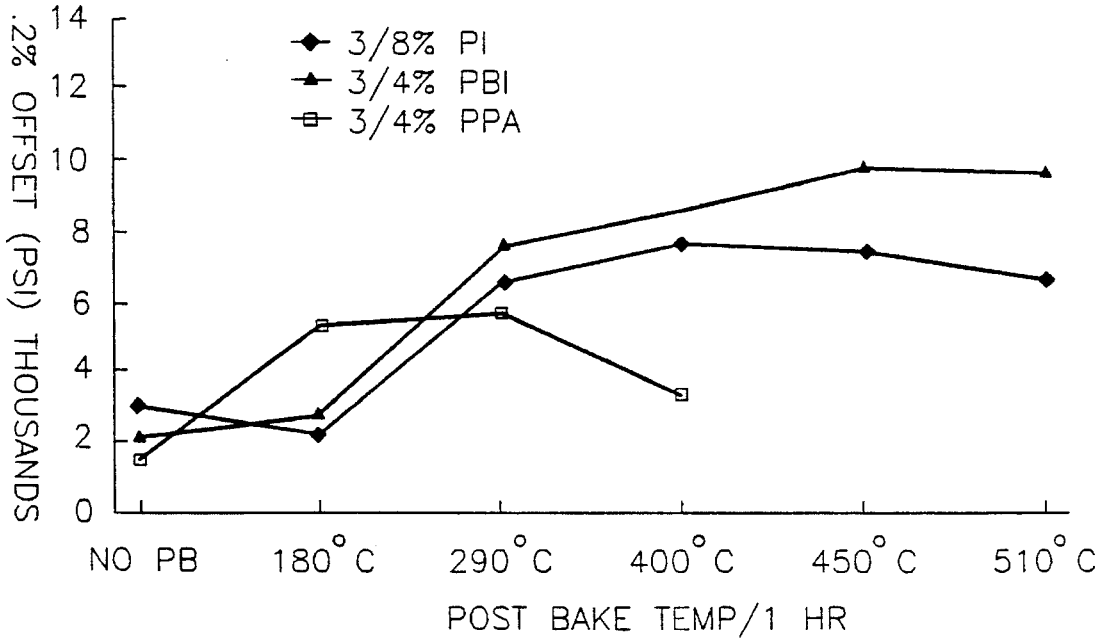

Results of the tensile tests are provided below in Table I, as well as FIGS. 1 and 2. In Table I and FIGS. 1 and 2, "PI" is used to indicate the results corresponding to the polyimide-coated transverse rupture bars, "PBI" is used to indicate the results corresponding to the polybenzimidazole-coated transverse rupture bars, and "PPA" is used to indicate the comparative results corresponding to the polyphthalamide-coated transverse rupture bars. The lack of data for an entry indicates that the coating material degraded to the extent that testing was not possible.

TABLE I

| | PPA | PI | PBI |
|---|---|---|---|
| No Post Bake | | | |
| Max Failure Load (psi) | 1855 | 2962 | 2310 |
| 0.2% Offset Load (psi) | 1542 | 2923 | 2181 |
| 180° C. Anneal | | | |
| Max Failure Load (psi) | 5537 | 2258 | 2911 |
| 0.2% Offset Load (psi) | 5325 | 2240 | 2750 |
| 290° C. Anneal | | | |
| Max Failure Load (psi) | 5964 | 9213 | 11270 |
| 0.2% Offset Load (psi) | 5721 | 6542 | 7621 |
| 400° C. Anneal | | | |
| Max Failure Load (psi) | 4277 | 12590 | 14220 |
| 0.2% Offset Load (psi) | 3353 | 7698 | 8642 |
| 450° C. Anneal | | | |
| Max Failure Load (psi) | — | 13170 | 15360 |
| 0.2% Offset Load (psi) | — | 7526 | 9788 |
| 510° C. Anneal | | | |
| Max Failure Load (psi) | — | 9932 | 15400 |
| 0.2% Offset Load (psi) | — | 6751 | 9730 |

The above data illustrates that the preferred coating materials of this invention exhibited suitable strength after annealing at the selected temperatures. In fact, the test bars actually required a heavier load for failure as the annealing temperatures were increased, with the polybenzimidazole (PBI) requiring the heaviest loads for failure at elevated temperatures up to and including 510° C. The specimens utilizing the preferred polyimide as the coating material exhibited some degradation in mechanical properties at about 510° C., indicating that a more optimum annealing temperature is closer to about 450° C. In contrast, the test bars utilizing polyphthalamide as the coating material exhibited the lowest mechanical properties at annealing temperatures above 180° C., with thermal degradation resulting in these specimens being too deteriorated for further testing at annealing temperatures above about 400° C.

It is believed that at their respective preferred annealing temperatures, the polybenzimidazole material and the preferred polyimides derived from 3-4'oxydianiline and polymethylene dianiline, sufficiently soften so as to allow the stresses present within the metal particles to be relieved, while the preferred polyimides also possibly imidize at the relatively high temperature, thereby resulting in a stronger, stress-free article.

The mechanical strength data was used to indicate the extent of polymer degradation. The results illustrate that the mechanical properties were enhanced after annealing these ferromagnetic bodies at temperatures of up to at least about 450° C.

To evaluate the effect that annealing has on the magnetic properties of magnetic bodies formed from the preferred coating materials, toroidal test samples were formed utilizing polybenzimidazole as the coating material by compression molding at about 290° C. with a molding pressure of about 50 tsi. The toroidal test samples had an outer diameter of about 2 inches, an inner diameter of about 1.7 inches, and a cross sectional thickness of about 0.25 inch. The toroidal samples were annealed at various temperatures for a duration of about one hour. An additional sample was not annealed for purposes of comparison. The polybenzimidazole coating was deposited such that the polybenzimidazole composed about 0.75 weight percent of the coated ferromagnetic particles.

The samples were then tested to determine permeability (m) when exposed to 100 Hz and 400 Hz AC currents. The best test results were achieved for the samples annealed at either 450° C. or 510° C., the data for these samples being illustrated in FIG. 3. The data obtained from these samples indicated that a substantial increase in permeability occurred for the samples which were annealed, in comparison to the sample which was not. Such results are compatible with the position that the compression molding process work hardens the molded articles, causing a corresponding decrease in magnetic permeability. By annealing the test samples, the stresses resulting from work hardening were sufficiently relieved so as to cause an increase in magnetic permeability, as shown by the results in FIG. 3. It is anticipated that the annealing method of this invention can readily increase magnetic permeability in excess of about 210 G/Oe as measured at about 50 oersteds field intensity and about 100 to about 400 Hz, for a given magnetic article formed from ferromagnetic particles encapsulated with the preferred coating materials of this invention, such that the magnetic article could be used in demanding AC applications.

To further evaluate the magnetic properties of magnetic bodies formed from the preferred coating materials, toroidal test samples of each preferred coating material were again formed by the compression molding method described above. Polybenzimidazole was deposited so as to compose about 0.75 weight percent of its respective coated particles, while the preferred polyimide was deposited so as to compose about 0.375 weight percent of its respective coated particles. The polyimide-coated samples had densities of about 7.4 g/cm$^3$, while the polybenzimidazole-coated samples had densities of about 7.5 g/cm$^3$.

A sample of each preferred coating material was then annealed in accordance with the best results achieved under the mechanical tests described above. The sample formed from ferromagnetic particles encapsulated with polybenzimidazole was annealed at about 510° C. for a duration of about one hour. The sample formed from ferromagnetic particles encapsulated with the preferred polyimide was annealed at about 450° C. for a duration of about one hour.

The samples were then tested to determine the magnetic field intensity (Hmax) in oersteds, flux density (Bmax) in gauss, total core loss (Pcm) in watts per pound, and permeability (m) when exposed to a DC current, a 100 Hz AC current and a 400 Hz AC current. Results of these tests are provided below in Table II. In the table, each of the coating materials are identified as before in Table I.

TABLE II

| | PI | PBI |
|---|---|---|
| DC current | | |
| Hmax (Oe) | 160 | 159 |
| Bmax (G) | 16,000 | 16,800 |
| Permeability (m) | 100 | 106 |
| Freq = 100 Hz | | |
| Hmax (Oe) | 59.1 | 75.9 |
| Bmax (G) | 12,520 | 15,100 |
| Permeability (m) | 212 | 198 |
| Core Loss (W/lb) | 23.0 | 39.8 |
| Freq = 400 Hz | | |
| Hmax (Oe) | 58.9 | 78.6 |
| Bmax (G) | 12,520 | 15,100 |
| Permeability (m) | 213 | 192 |
| Core Loss (W/lb) | 120 | 326 |

Figure 4:
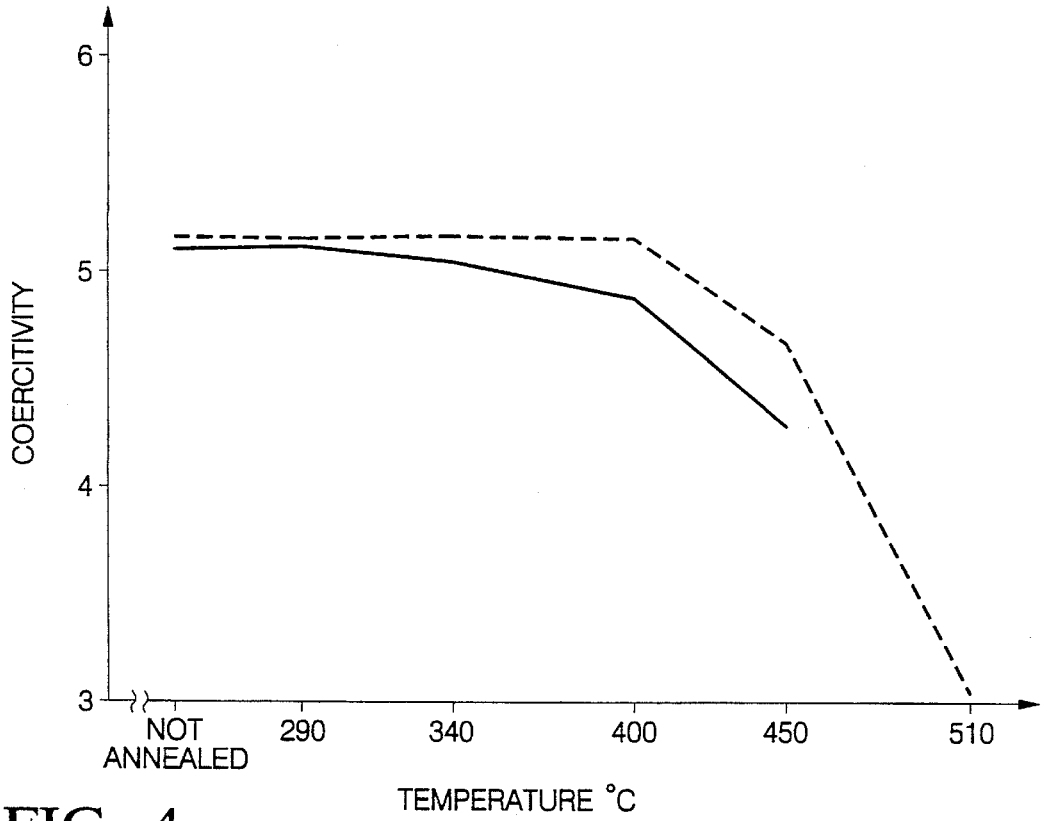
FIGS. 4–7 are graphs which illustrate the effect that annealing has on the coercivity of soft magnetic particles formed in accordance with this invention.
Figure 5:
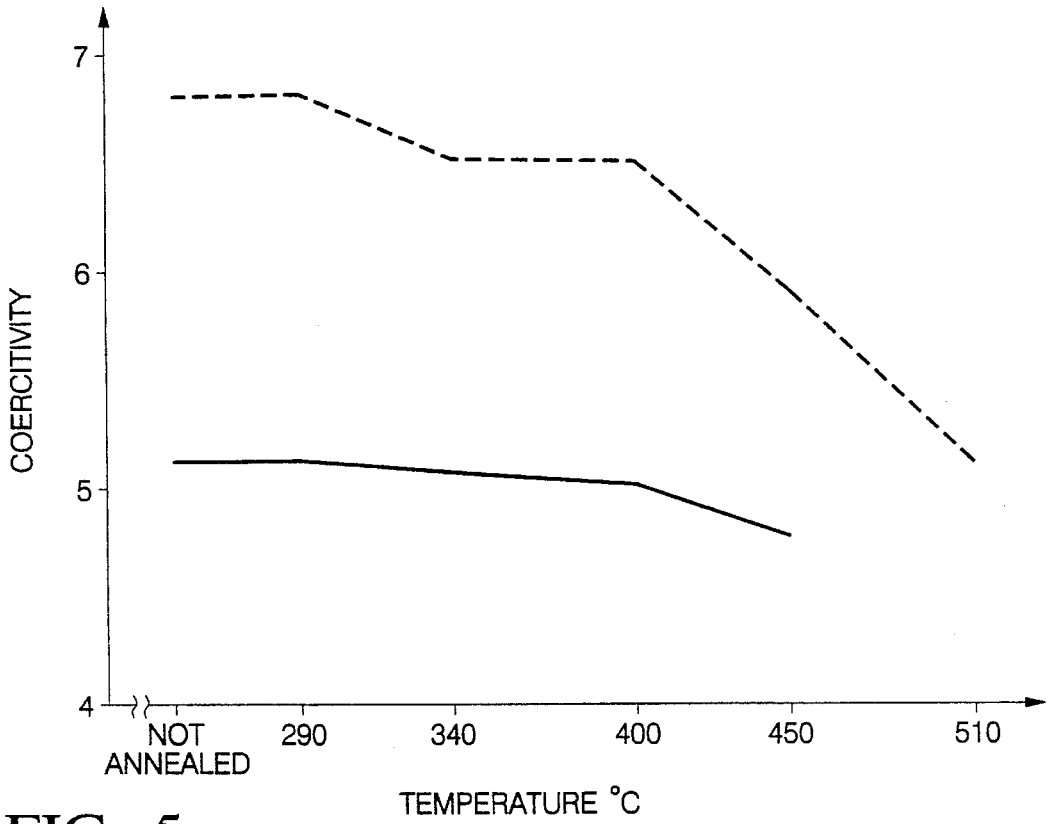
Figure 6:
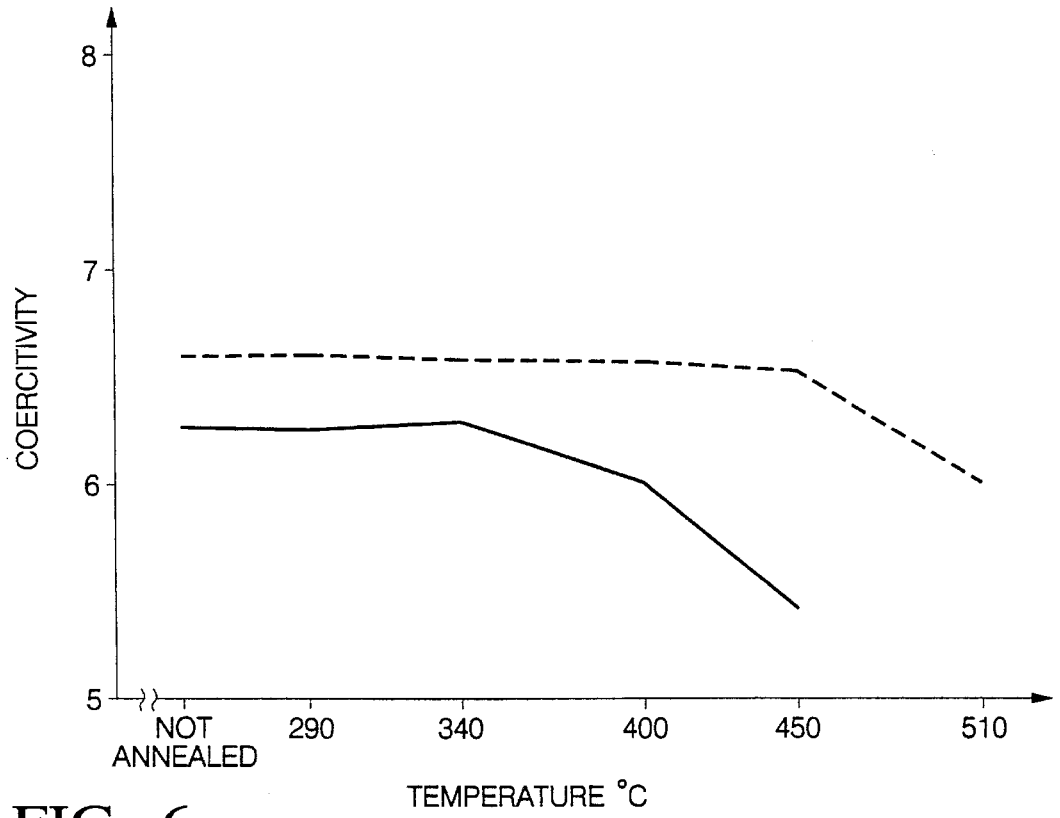
Figure 7:
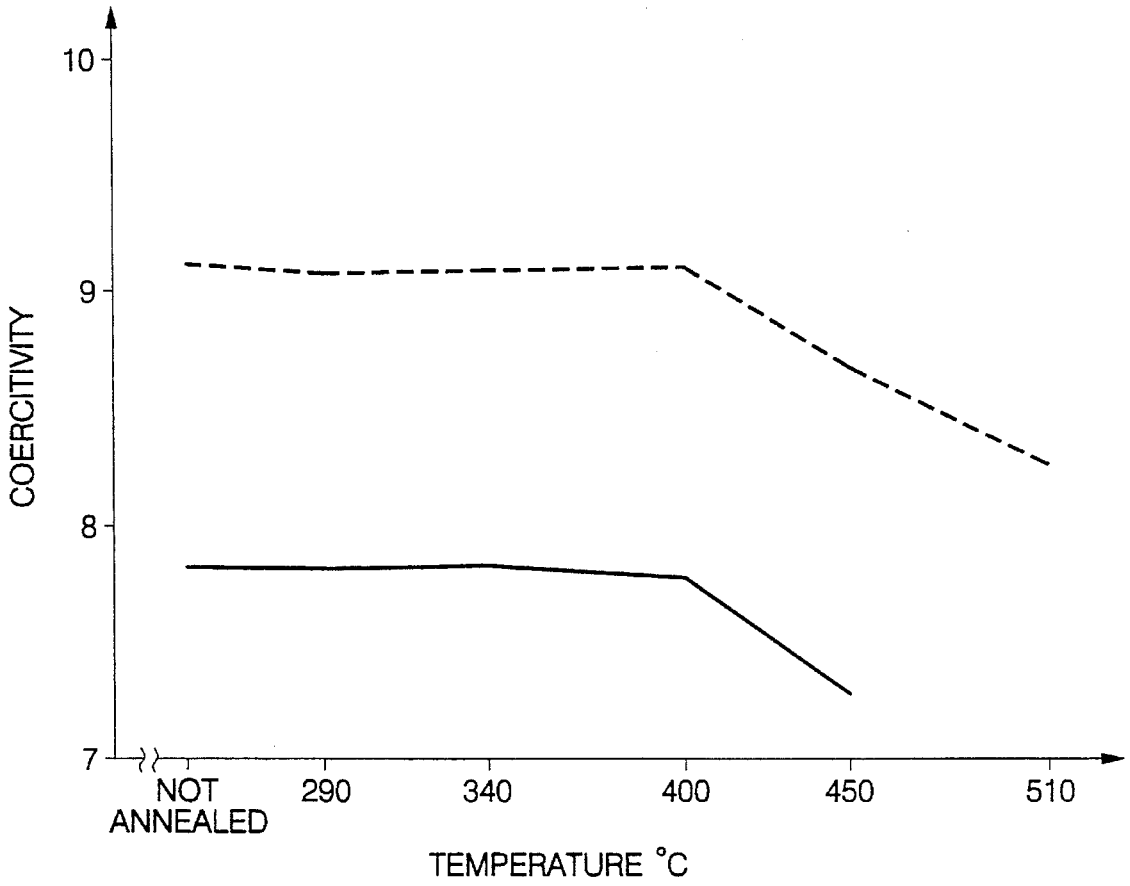

Finally, toroidal test samples made as described above with 0.75 weight percent of polybenzimidazole and 0.375 weight percent polyimide and molded at about 50 tsi were tested to determine the effects of heat treating temperature (i.e., for 1 hour) on coercivity measured at different frequencies and field intensities. In FIGS. 4–7, the solid line is the test results for polyimide while the dashed line is the test results for polybenzimidazoleo FIG. 4 shows the results for samples tested at 50 oersteds field intensity and direct current. FIG. 5 shows the results for samples tested at 150 oersteds field intensity and 50 Hz frequency. FIG. 6 shows the results for samples tested at 50 oersteds field intensity and 100 Hz frequency. FIG. 7 shows the results for sample tested at 50 oersteds field intensity and 400 Hz frequency. The results of these tests show that coercivity begins to drop significantly at heat treatment temperatures of about 400° C. or more, which corresponds to the 1 hour annealing temperature of the particular metal particles used.

Figure 3:
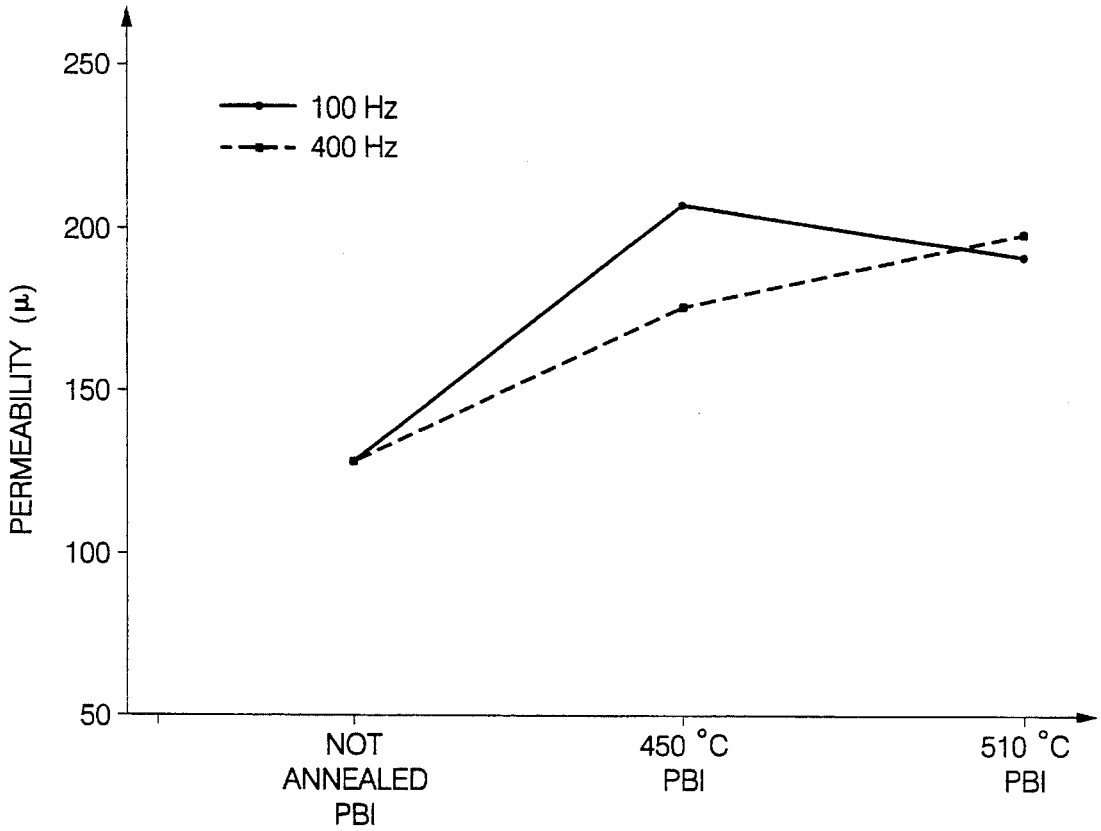
FIG. 3 is a graph which illustrates the effect that annealing has on the permeability of magnetic articles formed in accordance with this invention.

The above data, in conjunction with the results shown in FIG. 3, illustrates that useful magnetic core bodies having enhanced permeabilities and reduced coercivities were obtained by annealing the samples. While the polyimide (PI) samples exhibited lower core losses than the polybenzimidazole (PBI) samples, it is expected that improvements could be made to the polybenzimidazole (PBI) by achieving a more uniform coating on the individual ferromagnetic particles, or by using lower molding pressures. A possible explanation for the polyimide samples having lower core losses is that it is believed that the preferred polyimide partially imidizes during molding and almost fully imidizes during annealing.

From the above, it will be apparent to one skilled in the art that a significant advantage of the present invention is that there is provided a group of thermoplastic polymeric coatings for encapsulating powdered metals which are capable of withstanding temperatures sufficient to anneal a magnetic core that has been compression molded from the coated metal particles. As a result, the stresses induced into the metal through work hardening of the magnetic core during the compression molding process can be relieved without a significant loss in the mechanical properties of the magnetic core as a consequence of the degradation and/or pyrolyzation of the coating material during annealing. Furthermore, it is apparent that significant improvements in magnetic properties, more specifically, improvements in magnetic permeability and reduced coercivity can be achieved using the preferred coating materials in accordance with this invention. As a result, magnetic cores made in accordance with this invention are able to exhibit sufficiently higher magnetic permeability (on the order of about 210 G/Oe) and reduced coercivity so as to be useful in AC applications such as generators, stator cores, transformers and the like, which require magnetic permeability (such as in excess of about 175 G/Oe at about 50 oersteds field intensity and about 100 to about 400 Hz), and particularly low frequency species thereof which are particularly sensitive to high coercivities.

As noted in copending U.S. patent application Ser. No. 07/976,859, the temperature capabilities of the preferred coating materials are also beneficial for magnetic cores used in thermally hostile environments. The preferred coating materials imbue mechanical properties to the magnetic cores which include strength and high density as a result of strongly adhering the metal particles together.

Furthermore, the resistance of the preferred coating materials to high temperatures includes the ability to electrically insulate the metal particles from each other, so as to result in acceptable core losses for many applications, a critical magnetic characteristic for AC applications. The preferred coating materials are also highly resistant to a wide variety of chemicals, making their magnetic cores suitable for use in chemically hostile environments, such as the engine compartment of an automobile. In addition, the coating materials are sufficiently lubricous so as to enable high densities at typical molding temperatures.

While the invention has been described in terms of a preferred embodiment, it is apparent that other forms could be adopted by one skilled in the art; for example, by substituting other thermoplastic polymers having a heat deflection temperature of at least about 400° C., or by modifying the processing parameters such as the temperatures or pressures employed, or by substituting other appropriate powdered materials such as other magnetic or magnetizable materials, or by utilizing the particular materials and methods for use in alternative applications. Accordingly, the scope of the invention is to be limited only by the following claims.

What is claimed is:

1. A compression molded soft magnetic core comprising a coalesced body consisting essentially of a plurality of thermally stress-relieved soft ferromagnetic metal particles consisting essentially of iron which are each substantially surrounded and adhered together by a thermoplastic polymer having a heat deflection temperature of at least about 400° C. and selected from the group consisting of polybenzimidazole and polyimides wherein said polymer constitutes less than about one weight percent of said coalesced body.

2. A magnetic core as recited in claim 1 wherein the polymer is polyimide and constitutes about 0.25 to about 0.75 weight percent of said coalesced body.

3. A magnetic core as claimed in claim 2 wherein said core has a magnetic permeability of at least about 175 G/Oe as measured at about 50 Oe field intensity and about 100 to about 400 Hz.

* * * * *